US008418971B2

(12) United States Patent
Rayko et al.

(10) Patent No.: US 8,418,971 B2
(45) Date of Patent: Apr. 16, 2013

(54) UTENSIL HOLDING KIT

(76) Inventors: Jamie Lynn Rayko, Celebration, FL (US); Gerald Wesley Rayko, Celebration, FL (US)

( * ) Notice: Subject to any disclaimer, the term of this patent is extended or adjusted under 35 U.S.C. 154(b) by 92 days.

(21) Appl. No.: 13/113,355

(22) Filed: May 23, 2011

(65) Prior Publication Data

US 2012/0298807 A1 Nov. 29, 2012

(51) Int. Cl.
*A47G 21/14* (2006.01)

(52) U.S. Cl.
USPC ..... 248/37.6

(58) Field of Classification Search ..... 248/37.3, 248/37.6, 133, 371, 395; 30/123; 211/85.4, 211/70.7, 69.1
See application file for complete search history.

(56) References Cited

U.S. PATENT DOCUMENTS 4,659,053 A * 4/1987 Holley et al. ..... 248/663
5,678,790 A * 10/1997 Dwyer ..... 248/37.6
2009/0122424 A1* 5/2009 Perez ..... 359/809

* cited by examiner

*Primary Examiner* — Ramon Ramirez
(74) *Attorney, Agent, or Firm* — Daniel Law Offices, P.A.; Jason T. Daniel, Esq.

(57) ABSTRACT

A utensil holding kit includes a utensil tabletop holder having a body that includes an angled surface having and a concave portion into which a protrusion disc can be inserted, and a detachable protrusion disc configured to mate with the underside of a utensil in order to prevent the utensil endpoint from making contact with foreign objects and surfaces.

7 Claims, 3 Drawing Sheets

UTENSIL HOLDING KIT

BACKGROUND

Field of the Invention

The present invention relates to kitchen utensil holders and more particularly to a tabletop utensil holder for reducing contact between cutlery and tabletop surfaces.

Kitchen utensils are an essential part of daily life, and are utilized by consumers in home and restaurant settings. In the past, there have been many systems and methods for properly cleaning kitchen utensils to ensure they are sanitary for successive use. However, it is common for these sanitized utensils to be placed on a tabletop that has not been properly cleaned, thus contaminating the utensils and fostering the spread of illness and disease.

Additionally, there have been many devices directed to storing and/or arranging silverware, such as silverware chests and molded holders, for example, but each of these fail to preserve the sanitary condition of the utensils by preventing contact with a table surface.

SUMMARY OF THE INVENTION

It is an object of the invention to provide a utensil tabletop holder for allowing uniform, organized and sanitary placement of eating utensils.

It is another object of the invention to provide a detachable utensil stand configured to mate with conventional silverware and a tabletop holder in order to prevent the utensil endpoint from making contact with foreign objects.

Accordingly, there is provided a utensil tabletop holder having a body that includes an top surface having and a concave portion into which a protrusion disc can be inserted, and a detachable protrusion disc configured to mate with the underside of a utensil and configured to prevent the endpoint of a utensil from resting on a foreign surface while not in use.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1:
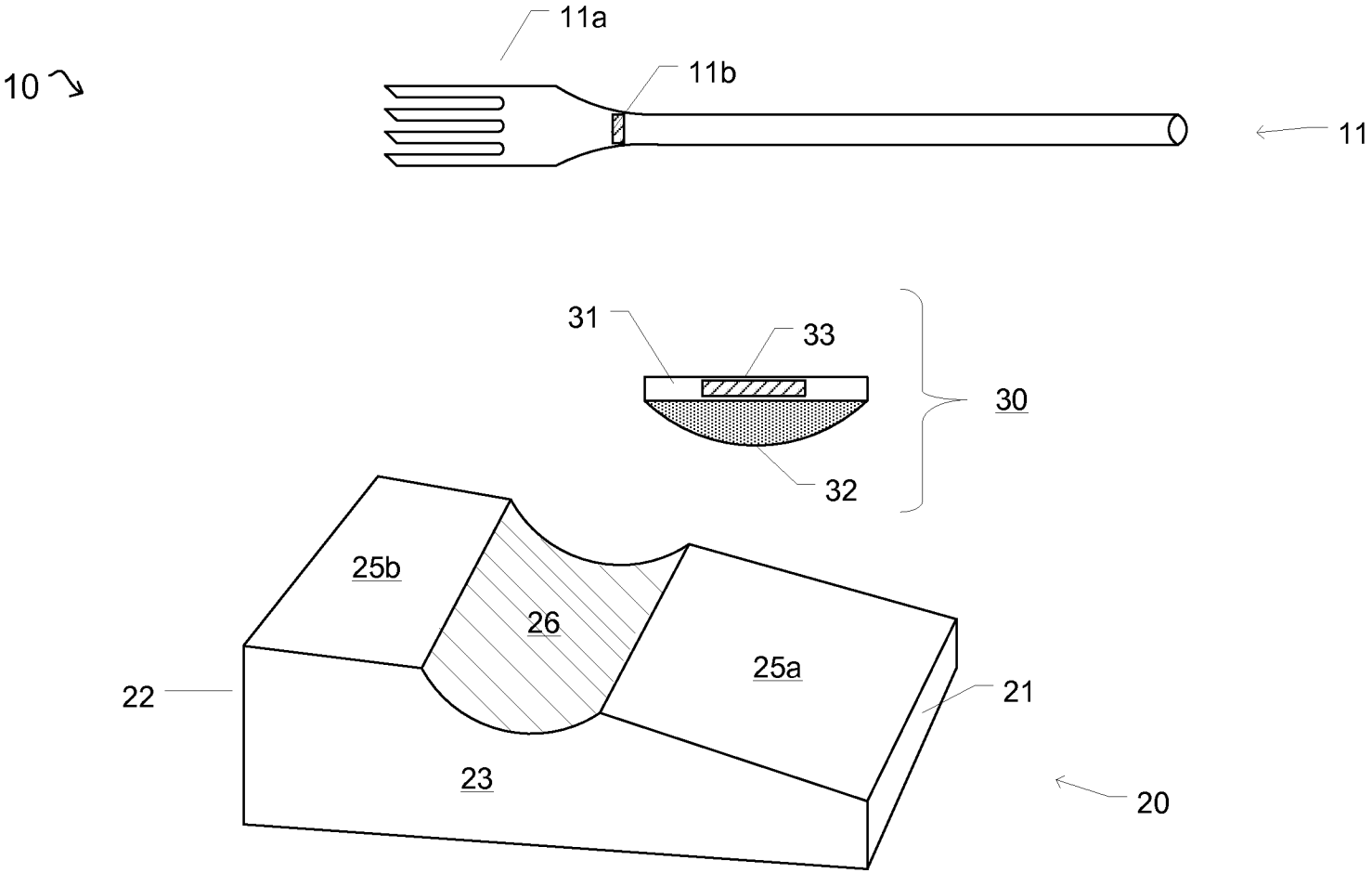
FIG. 1 is an exploded view of a utensil holding kit in accordance with one embodiment of the invention.

For purposes of this description, the terms "upper," "bottom," "right," "left," "front," "back," "top," "vertical," "horizontal," and derivatives thereof shall relate to the invention as oriented in FIG. 1. As described herein, a "tabletop" can include virtually any surface onto which objects can be placed (i.e. countertops, kitchen tables, serving dishes, plates, etc.).

FIG. 1 illustrates one embodiment of a utensil holding kit 10 that includes a tabletop utensil holder 20 and a detachable utensil stand 30. As shown, the utensil stand 30 is configured to be attached to a conventional piece of cutlery such as a fork 11.

The tabletop utensil holder 20 can act to uniformly position typical household and restaurant eating utensils such as knives forks and spoons, for example, in a uniform, organized and sanitary fashion. The utensil holder can work with traditional utensils as well as a utensil with an integrated stand such as that described in U.S. patent application Ser. No. 13/113,304, the contents of which are incorporated herein by reference.

As shown, the tabletop utensil holder 20, according to one embodiment, can include a front section 21, a back section 22, two opposing side sections 23, a bottom section 24 and a top section 25 having a lower half 25*a* and an upper half 25*b*. Positioned between the upper and lower halves of the top section 25 is a semicircular indentation 26.

As described herein, the utensil holder 20 can act to uniformly position utensils on a tabletop prior to a meal in order to prevent the sanitized endpoint 11*a* of a utensil from making contact with a potentially contaminated tabletop surface. To this end, in one preferred embodiment, the utensil holder 20 can be constructed from injection molded plastic having identifiable sections as heretofore described. Of course, one of skill in the art will recognize that the utensil holder 20 can be constructed in any number of different shapes and from any number of known materials and construction methodologies.

The detachable utensil stand 30 (i.e. protrusion disc) can act to prevent the tip of an eating utensil 11*a* from making contact with foreign objects. To this end, the detachable utensil stand 30, according to one embodiment, can include a generally planar top surface 31 having a strong adhesive material 33 secured thereon in order to securely affix the stand 30 to the bottom of a utensil 11. Additionally, the stand 30 includes a convex lower portion 32 forming a downward facing protrusion. In one preferred embodiment, the downward protrusion 32 can be greater than the semicircular indentation 26 so as to ensure a gap A remains when contact between these two devices is made (see FIG. 3). Alternatively, the downward protrusion 32 can have a shape approximating that of the semicircular indentation 26 so as to allow the protrusion 32 of the stand 30 to fit evenly within the indentation 26 of the utensil holder 20.

In one preferred embodiment, the utensil stand 30 can be secured to the bottom of the utensil 11 at a location adjacent to the neck 11*b* so as to not affect the traditional and familiar use/handling of the utensil. Additionally, it is preferred that the utensil stand 30 be constructed from a single piece of stainless steel or other metallic elements having a feel and color similar to that of conventional utensils. To this end, when secured to a utensil, the stand 30 can appear to be an original component as opposed to a separate piece.

Although described above as utilizing specific shapes and materials, one of skill in the art will recognize that the protrusion disc 30 can include virtually any shape having a depth sufficient to extend below the bottom of the utensil endpoint 11*c*, so as to prevent the endpoint from making contact with a surface 15 such as a tabletop, for example.

As described herein, an adhesive material 33 can include any number of known substances capable of creating a secure bond between two objects, such as glue and double sided tape, for example. Alternatively, the adhesive material 33 can include any number of known materials capable of securing two objects together in a removable fashion. Several non-limiting examples include hook and loop material (i.e. Velcro®) and small magnetic elements having opposite polarities wherein each magnet is individually secured to one of the stand or the utensil, and are configured to create a removable attachment point when the two objects come into close proximity.

Figure 2:
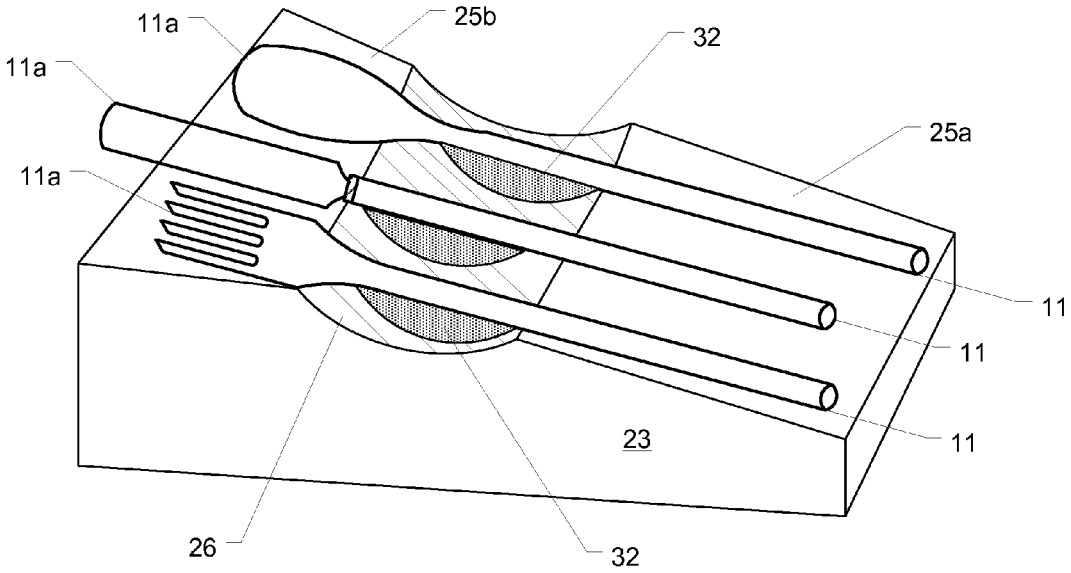
FIG. 2 is a perspective view of a utensil holding kit in accordance with one embodiment of the invention.
Figure 3:
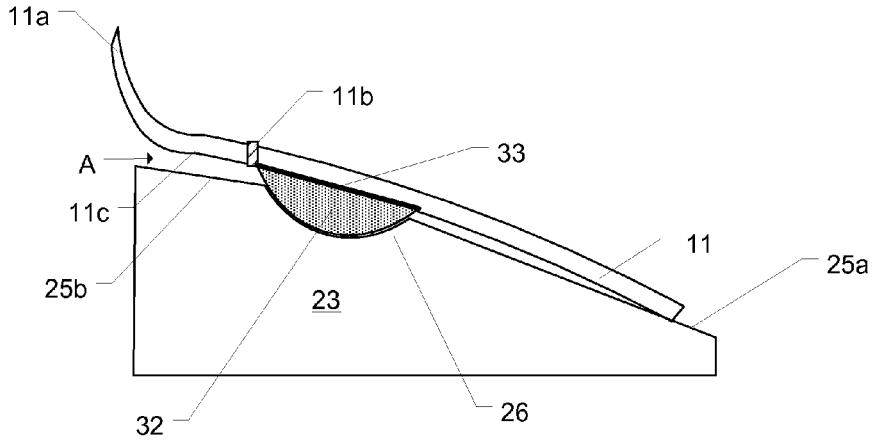
FIG. 3 is a side view of a utensil holding kit in accordance with one embodiment of the invention.

As illustrated in FIGS. 2 and 3, once secured to the bottom of a utensil 11, each stand 30 can act to securely position the utensil onto the holder 10 in an organized and uniform fashion. As described above, it is preferred that when a utensil is placed onto the holder 20, the endpoint of the utensil 11*a* (i.e. the part that makes contact with food and/or the mouth of a user) is elevated above the top of the holder 15*b*, thus preventing the utensil from making contact with any foreign objects (see arrow A).

Figure 4:
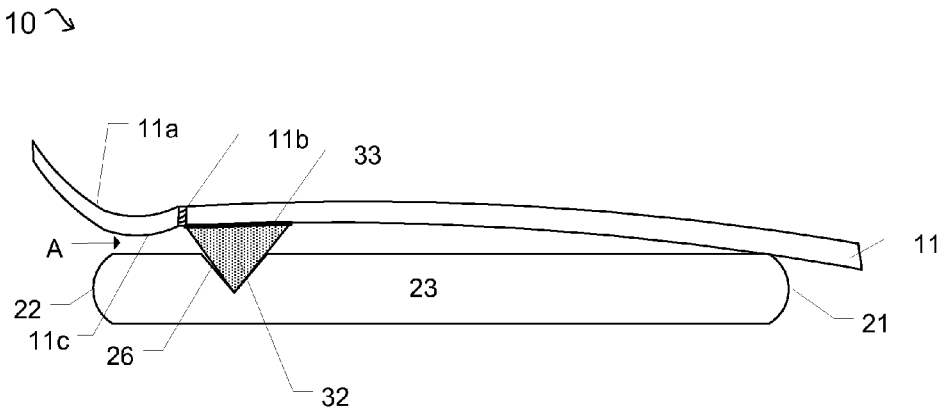
FIG. 4 is a side view of the utensil stand in accordance with another embodiment of the invention.

Although described above as utilizing specific shapes and materials, one of skill in the art will recognize that each of the protrusion disc 30 and the utensil holder 20 can include any number of different shapes and sizes (See FIG. 4), accordingly, the invention is not limited to the specific orientations illustrated in the drawings.

Figure 5:
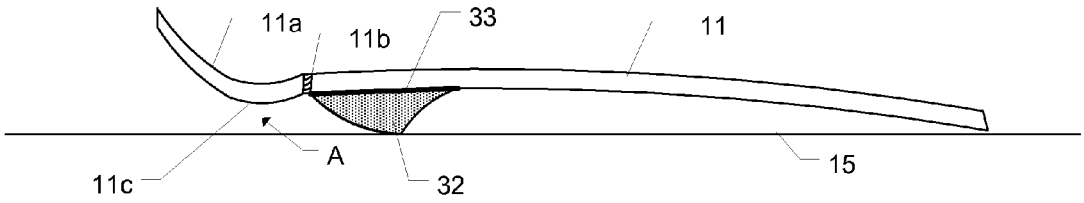
FIG. 5 is a side view of the utensil stand in accordance with one embodiment of the invention.

Additionally, as illustrated in FIG. 5, the utensil stand 30 can act to protect the endpoint of a utensil 11*a* from making contact with foreign objects without the aid of the holder 20. Owing to the fact that the bottom of the stand 30 extends below the lowest portion of the utensil endpoint 11*c*, the stand 30 will keep the utensil endpoint at an elevated position at all times, thus preserving the sanitary condition of the utensil.

Although described above as for use on particular eating utensils, on of skill in the art will recognize that the inventive concepts disclosed herein can be equally applied to eating utensils of all types such as knives and serving instruments, for example, without deviating from the scope and spirit of the inventive concepts disclosed herein.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A utensil holding kit, comprising:

a holder configured to position at least one utensil in an upright manner, said holder including a top surface and a bottom surface having a plurality orthogonally oriented side surfaces connected therebetween, wherein said top surface further includes a downward indentation; and a protrusion disc configured to secure to the bottom of a utensil, said protrusion disc having a top surface, a bottom surface and a means for securing to the utensil, wherein the protrusion disc is configured to rest within the indentation so as to prevent a utensil endpoint from making contact with a foreign surface.

2. The utensil holding kit of claim 1, wherein the indentation includes a circular shape.

3. The utensil holding kit of claim 1, wherein the protrusion disc includes a depth that is greater than a depth of the indentation.

4. The utensil holding kit of claim 1, wherein the protrusion disc is removably secured to the utensil.

5. The utensil holding kit of claim 1, wherein the protrusion disc is permanently secured to the utensil.

6. The utensil holding kit of claim 1, wherein the protrusion disc includes a depth that is greater than a depth of a bottom surface of the utensil endpoint.

7. The utensil holding kit of claim 6, wherein the protrusion disc is configured to prevent the utensil endpoint from making contact with a table surface.

* * * * *